United States Patent [19]

Croteau

[11] 4,397,043

[45] Aug. 9, 1983

[54] IMPACT-PROTECTIVE SUIT FOR RACQUETBALL

[76] Inventor: James C. Croteau, 4506 Morrison St., Niagara Falls, Ontario, Canada

[21] Appl. No.: 300,717

[22] Filed: Sep. 10, 1981

[30] Foreign Application Priority Data

Sep. 12, 1980 [CA] Canada ..... 360143

[51] Int. Cl.[3] ..... A41D 13/00

[52] U.S. Cl. ..... 2/2; 2/22

[58] Field of Search ..... 2/2, 22, 227, 93, 97, 2/24

[56] References Cited

U.S. PATENT DOCUMENTS

| | | | |
|---|---|---|---|
| 1,005,569 | 10/1911 | DeMeir . | |
| 1,478,626 | 12/1923 | Wares . | |
| 2,664,566 | 1/1954 | Mianulli | 2/2 |
| 3,116,489 | 1/1964 | Weiss | 2/97 |
| 3,550,159 | 12/1970 | Alarco | 2/2 |
| 3,771,171 | 11/1973 | Mitchell | 2/2.5 |
| 4,035,844 | 7/1977 | Atack et al. | 2/2 |
| 4,059,852 | 11/1977 | Crane | 2/2 |
| 4,179,752 | 12/1979 | Fackelmann | 2/2 |

*Primary Examiner*—Doris L. Troutman
*Attorney, Agent, or Firm*—Timothy R. Kroboth

[57] ABSTRACT

An impact-protective suit for racquetball that enables the wearer to play aggressively, that permits free unrestricted movement during play and that readily vents body heat. The suit includes a shirt portion and a pants portion, which are made of an outer material, a lining, and a selectively located impact-protective material intermediate the outer material and the lining. The impact-protective material completely covers only the back side of the wearer, the front side of the wearer thereby being uncovered by the protective material.

3 Claims, 3 Drawing Figures

10
12
14
16
18
20
22
III
III

IMPACT-PROTECTIVE SUIT FOR RACQUETBALL

TECHNICAL FIELD

This invention relates to an article of clothing. More particularly, the invention relates to a protective suit useful in sports, particularly for playing racquetball.

BACKGROUND ART

In the game of racquetball, a ball is struck by a racquet inside an enclosed court and caused to travel at speeds anywhere between 60 and 100 mph and at times even faster. One of the enclosing walls is designated the "front wall", and in the game, the players alternate striking the ball so that it contacts this wall prior to contacting the floor. Often, a player winds up in a position on the court between the front wall and his opponent who is preparing to strike the ball. In this position, the player is vulnerable to being struck by the ball, which produces injuries such as ball burns, deep cuts, broken ribs and even kidney injuries. In order to reduce the hazard, many players work out running patterns and angles on the court. However, this reduces a player's ability to attack the ball in a totally aggressive manner and sometimes can result in a player not being in the best position to make a return. Therefore, there is a need to protect a racquetball player against ball impact so that the player can be totally aggressive.

A player struck by the ball not only undergoes pain due to the type of injuries described above, but also may undergo a breakdown in concentration that subsequently interferes with aggressiveness. Thus, by protecting a player against ball impact, player performance will improve and new excitement will be added to the sport.

In racquetball, the ball can be caused to strike the ceiling or sidewalls and thus travels in all directions, making the whole body a target. However, a player must have free, unrestricted movement and must be comfortable, temperaturewise.

Protective suits that completely cover the upper and lower portions of the body are known. Exemplary suits of this type are disclosed in U.S. Pat. No. 1,005,569 to DeMeir, U.S. Pat. No. 2,664,566 to Mianulli, U.S. Pat. No. 4,059,852 to Crane, U.S. Pat. No. 4,179,752 to Fackelmann. Certain of these suits also protect the head and/or feet.

It is also known to protect only portions of the body, with this type of prior art being illustrated by U.S. Pat. No. 1,478,626 to Wares, U.S. Pat. No. 3,116,489 to Weiss, U.S. Pat. No. 3,550,159 to Alarco, U.S. Pat. No. 3,771,171 to Mitchell, and U.S. Pat. No. 4,035,844 to Atack et al. In the Wares patent, only a portion of the back side is protected.

This prior art and the other prior art of which I am aware does not provide an impact-protective suit that enables a racquetball player to play aggressively, that gives the player free, unrestricted movement and that permits ready venting of body heat.

SUMMARY OF THE INVENTION

It is accordingly, an object of the present invention to provide an impact-protective suit for racquetball that enables the wearer to play aggressively.

It is a further object to provide an impact-protective suit that permits free, unrestricted movement during play.

It is a still further object to provide an impact-protective suit that readily vents body heat.

Other objects and advantages of the present invention will become apparent as the description thereof proceeds.

In satisfaction of the foregoing objects and objectives, there is provided in accordance with the invention, an impact-protective suit for racquetball. This suit comprises a shirt portion and a pants portion. The shirt and pants portions are made of an outer material, a lining, and a selectively located impact-protective material, intermediate the outer material and the lining. The impact-protective material completely covers only the back side of the wearer so as to protect the wearer against injury resulting from impact to the back side, thus enabling the wearer to play aggressively. The front side of the wearer is thereby uncovered by the impact-protective material so as to permit free, unrestricted movement during play and ready venting of body heat.

Also provided by the present invention is a method of playing racquetball that comprises wearing the impact-protective suit described above, thereby being protected against injury resulting from impact to the back side.

In the description of the drawing and in the detailed discussion of the invention which follows, there is shown and essentially described only the preferred embodiment of the invention, simply by way of illustration of the best mode contemplated by me of carrying out the invention. As will be realized, the invention is capable of other and different embodiments and its several details are capable of modification in various respects, all without departing from the invention. Accordingly, the drawings and description are to be regarded as illustrative in nature, and not as restrictive.

BRIEF DESCRIPTION OF THE DRAWING

Reference is hereby made to accompanying drawing, which forms a part of the specification of the present invention.

BEST MODE FOR CARRYING OUT THE INVENTION

Figures 1, 2, 3:
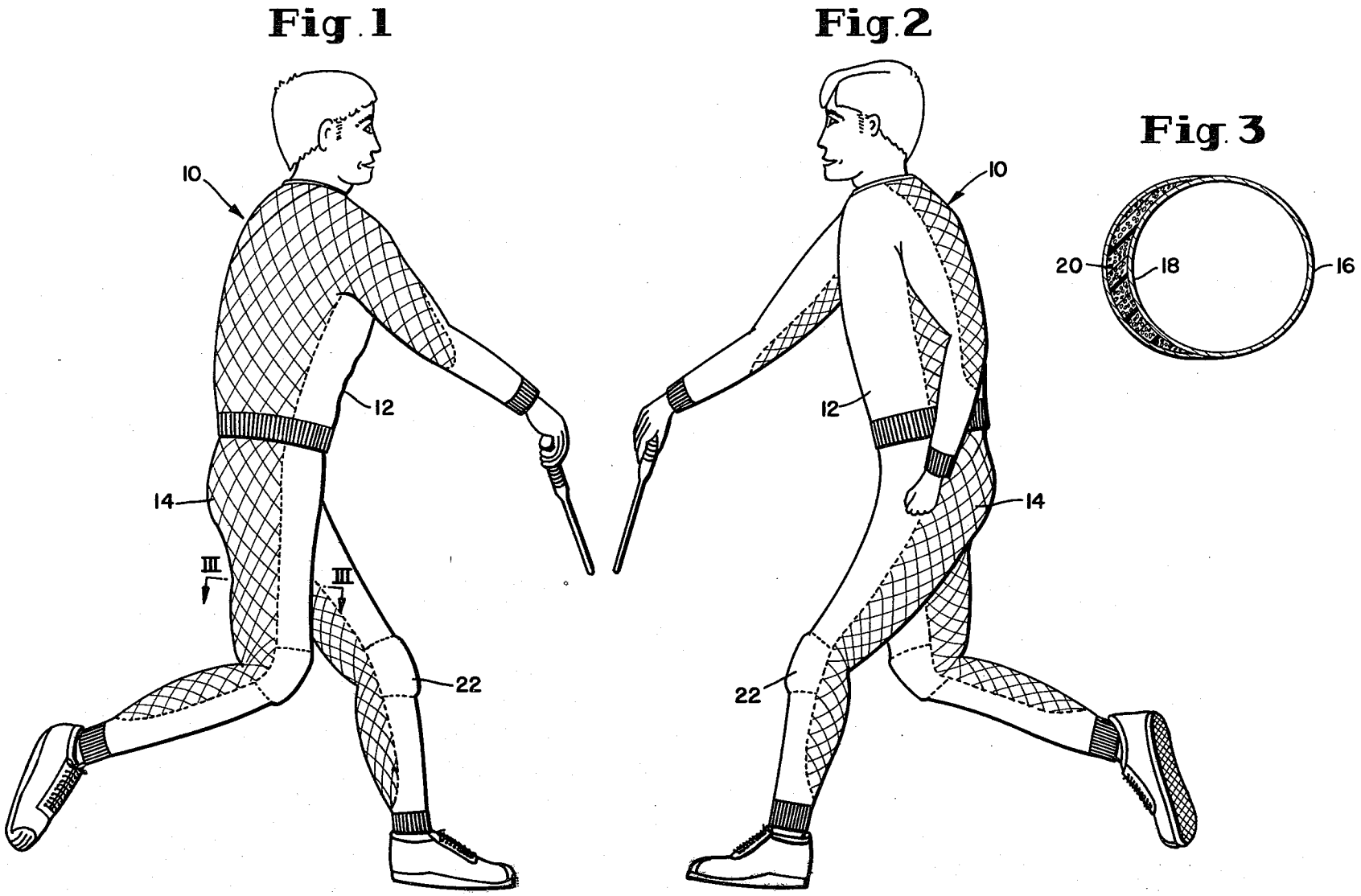
FIG. 1 is a perspective view of a person wearing the impact-protective suit of the present invention.
FIG. 2 is a perspective view from the other side of a person wearing the impact-protective suit shown in FIG. 1.
FIG. 3 is an enlarged cross-sectional view taken along line III—III of FIG. 2.

Referring to the Figures, an impact-protective suit 10, in accordance with the present invention, is provided. Suit 10 comprises a shirt portion 12 and a pants portion 14. Shirt 12 and pants 14 are made of an outer material 16, a lining 18, and an impact-protective material 20. Protective material 20 is between outer material 16 and lining 18.

Lining 18 is located only where protective material 20 is found. However, suit 10 could be completely lined. It is preferred to use lining 18 only where material 20 is found in order to reduce the weight of the suit and to increase the venting of body heat provided by the portion of suit 10 that covers the front side of the wearer.

Outer material 16, lining 18 and impact-protective material 20 are conventional materials. The fabrics used in outer material 16 and lining 18 should be lightweight and breathe so as to permit ready venting of body heat. Additionally, the fabric of which outer material 16 is constructed should be tear-resistant. Similarly, impact-protective material should be lightweight and breathe. Material 20 is single-layered but could be multi-layered. Venting of body heat could be increased by providing vent holes in the impact-protective material.

Material 20 is located so as to protect the back side of the wearer. As shown in FIGS. 1 and 2, the back side runs from one side of the body to the other side, runs from the neck area to the ankle area, and includes the back of each upper arm and each elbow. I have discovered that completely covering this portion of the body protects the wearer against injury resulting from impact to the back side and thus enables the wearer to play aggressively. In this way, the front side of the wearer is uncovered by the protective material and thus the wearer has free, unrestricted movement during play and there is ready venting of body heat. Thus, a player wearing my suit can work out and develop aggressive running patterns on the court, so as to be able to attack the ball in a totally aggressive fashion. This unit will protect the wearer against not only ball impact, but also impact from another player's racquet or impact from running into another player or into a wall.

In addition to covering the back side, protective material 20 covers each knee. However, this is only a preferred feature of my protective suit.

Protective material 20 is held in place by quilting. However, any method of holding the material in place may be used.

In this disclosure, there is shown and essentially described only the preferred embodiment of my impact-protective suit, but as mentioned above, it is to be understood that my suit is capable of changes or modifications within the scope of the inventive concept expressed herein. Several changes or modifications have been briefly mentioned for purposes of illustration.

I claim:

1. An impact-protective suit for racquetball that enables the wearer to play aggressively, that permits free, unrestricted movement during play, and that readilly vents body heat, said suit comprising a shirt portion and a pants portion, said portions being made of an outer material, a lining, and a selectively located impact-protective material, intermediate said outer material and said lining; said impact-protective material completely covering only the back side of said wearer so as to protect said wearer against injury resulting from impact to said back side, thus enabling said wearer to play aggressively; the front side of said wearer thereby being uncovered by said impact-protective material so as to permit free, unrestricted movement during play and ready venting of body heat.

2. The suit of claim 1, wherein said lining is located only where said impact-protective material is found.

3. The suit of claim 1, wherein said impact-protective material additionally covers each knee of said wearer.

* * * * *